US006033141A

United States Patent [19]

Blaustein et al.

[11] Patent Number: 6,033,141

[45] Date of Patent: Mar. 7, 2000

[54] CAPLESS RETRACTABLE SEALED MARKING INSTRUMENTS

[75] Inventors: Lawrence A. Blaustein, Moreland Hills; Patrick W. Brown, Strongsville; Shane Vanderlinden, S. Euclid, all of Ohio

[73] Assignee: Nottingham-Spirk Design Associates, Inc., Cleveland, Ohio

[21] Appl. No.: 08/722,907

[22] Filed: Sep. 27, 1996

[51] Int. Cl.[7] ..... B43K 23/08; B43K 24/00

[52] U.S. Cl. ..... 401/107; 401/108

[58] Field of Search ..... 401/107, 108, 401/122, 66

[56] References Cited

U.S. PATENT DOCUMENTS

| | | | |
|---|---|---|---|
| 261,457 | 7/1882 | Hoffman | 401/66 |
| 1,541,826 | 6/1925 | Kroutl | 401/66 |
| 2,582,451 | 1/1952 | Mureau . | |
| 2,957,452 | 10/1960 | Brannon | 401/108 |
| 3,583,820 | 6/1971 | Koeln . | |
| 3,594,091 | 7/1971 | Bleuer | 401/107 |
| 4,076,427 | 2/1978 | Anderson . | |
| 4,269,525 | 5/1981 | Melikian . | |
| 4,572,688 | 2/1986 | Klose . | |
| 4,696,594 | 9/1987 | Powers . | |
| 4,741,437 | 5/1988 | Gorski et al. . | |
| 4,759,650 | 7/1988 | Granoff . | |
| 4,929,107 | 5/1990 | Kageyama et al. . | |
| 4,969,766 | 11/1990 | Nagle et al. . | |
| 5,004,362 | 4/1991 | Palmer . | |
| 5,017,034 | 5/1991 | Stary et al. . | |
| 5,067,837 | 11/1991 | Panopoulos . | |
| 5,092,701 | 3/1992 | Lai . | |
| 5,131,774 | 7/1992 | Katz . | |
| 5,149,219 | 9/1992 | Kageyama et al. . | |
| 5,171,097 | 12/1992 | Nagaoka et al. . | |
| 5,174,814 | 12/1992 | Burwell et al. . | |
| 5,207,523 | 5/1993 | Wittek . | |
| 5,290,116 | 3/1994 | Chang . | |

FOREIGN PATENT DOCUMENTS

| | | | |
|---|---|---|---|
| 1561812 | 4/1970 | Germany | 401/107 |
| 1561813 | 4/1970 | Germany | 401/107 |
| 612885 | 8/1979 | Switzerland | 401/108 |

*Primary Examiner*—Steven A. Bratlie

*Attorney, Agent, or Firm*—Jeanne E. Longmuir; Calfee, Halter & Griswold LLP

[57] ABSTRACT

Capless retractable sealed marking instruments have a single piece elastomeric seal incorporated in a marker casing. The seal includes an annular rim and a concave disk with cooperative sealing disk halves having lateral sealing surfaces which are moved out of contact by a linearly advanced marker nib to open the seal for extension of the marker nib. The concave configuration of the disk provides maximum sealing force between the lateral sealing surfaces of the disk halves. Retraction of the marker nib draws the disk halves back into the concave sealed configuration to protect the marker nib and cartridge from atmospheric degradation.

7 Claims, 4 Drawing Sheets

CAPLESS RETRACTABLE SEALED MARKING INSTRUMENTS

FIELD OF THE INVENTION

The present invention pertains generally to marking and writing instruments and, more particularly, to marking and writing instruments having ink-impregnated applicators or cartridges, and in particular ink-impregnated markers adapted for use by children.

BACKGROUND OF THE INVENTION

Markers, including broad-nib markers, are especially attractive to children for the intense markings producible with letter pressure. Unfortunately, the intensity of the markings is rapidly depleted without sealed protection of the marking nib during periods of non-use. Marking nib protection is accomplished in the prior art by caps which fit tightly upon the marker casing. Caps are problematic for children who tend to put in them in their mouths and thereby risk choking or ingestion. And even older children have difficulty removing and replacing tight fitting caps. Caps can also be easily lost, thereby rendering the accompanying marker useless in a very short period of time.

Ink impregnated marking and writing instruments, commonly known as "markers" have a fabric or polymeric ink carrier, one end of which forms the marking or writing tip or nib. The term "markers" as used herein includes all such instruments having a fabric or fibrous or polymeric ink carrier and nib, including for example but not limited to felt-tipped pens, highlighters, permanent and non-permanent markers, grease pens, and children's' markers. The ink-impregnated carrier may serve as the ink cartridge, or be in contact with a fluid ink reservoir, with the ink flowing to the marking nib by capillary action.

Exposure of the marking nib to the atmosphere causes rapid evaporation of ink from the carrier at the nib, and resultant drying of the nib material which blocks the flow of fresh ink to the nib. This is why it is necessary to tightly cover the marker nib of marking instruments.

Most markers have plastic caps which securely fit over the nib in contact with the instrument shaft or body. The cap is thus necessarily detachable from the instrument and therefore easily lost. Loose marker caps are an obvious danger to small children who may swallow them. With most markers it is necessary to fly snap the cap onto the shaft to insure adequate sealing of the nib from the atmosphere. This is also a problem for children not strong enough to either remove the cap or replace it tightly.

U.S. Pat. No. 4,269,525 describes a retractable marker pen with a shield mechanism 16 in the form of a flexible disk positioned immediately at the writing tip opening of the barrel of a pen, to flexibly open and close as the pen tip emerges and retracts relative to the opening. In practice, however, the design and configuration of the flexible seal is critical to its operation and, most importantly, effectiveness as an atmospheric barrier. For example, each slit in the membrane which forms the seal provides an additional path for air to enter the marker or pen barrel which houses the marker nib, and creates a plurality of pie-shaped flaps which with wear can become too flexible and fail to return to the sealed position with adjacent flaps. Each flap must seal on both its edges to adjacent flaps. Longevity and durability of the seal is also a major concern. The seal must remain intact throughout long periods of non-use, and survive thousands of extension/retraction cycles. The seal design of the '525 patent is deficient in these respects, having multiple radial slits which increase the number of air paths to the interior of the pen, and being positioned at the very tip of the writing instrument where it is fully exposed to mechanical and atmospheric degradation.

U.S. Pat. No. 5,092,701 describes an adult writing pen with a complex three-disk seal assembly in the front pen socket. The seal assembly is opened by a sliding sleeve which surrounds the writing nib. This design also suffers from its own complexity, in particular the difficulty of holding the three disks of the seal assembly in the described misalignment. Also, the described Y-shaped slits in each of the disks are not ideally suited to form and maintain a tight seal. In fact, every incision in a member which defines relatively movable parts of the seal weakens the sealing force at the mating surfaces of the parts. In other words, each of the parts becomes more flexible, exerting less force against adjacent parts. Seals with multiple slits are also more susceptible to mechanical degradation and damage, as may be induced by the repeated linear and rotational movements of the writing nib and the sleeve against the seal.

There is thus absent from the prior art a retractable capless marker which has a highly effective marker nib seal of a relatively simple design, which eliminates the need for a separate cap, and which is ideally suited for use by children.

SUMMARY OF THE INVENTION

The present invention overcomes these and other disadvantages of the prior art by providing a capless retractable sealed marker, specially adapted for use by children, which has in internal atmospheric seal through which a marker nib can be extended and retracted, thereby completely eliminating the need for a cap while protecting the moisture in the marker nib and cartridge from dehydration.

The capless retractable sealed marking instruments of the invention include a marker casing, an ink-impregnated marker cartridge, a marker nib at a distal end of the marker cartridge, a marker carrier mechanism connected to the marker cartridge and operative to linearly advance and retract the marker cartridge within the marker casing and to project the marker nib through an open end of the marker casing, and a single piece seal disposed within the marker casing proximate to the open end of the marker casing, the single piece seal having a generally annular rim held within the marker casing in a plane generally perpendicular to a longitudinal axis of the marker casing, and a concave flexible disk attached to and within the circular opening of the annular rim, the concave disk having a cross-section in the form of an arc with an apex of the arc oriented to face the marking nib when the marking nib is in a fully retracted position within the marker casing, and a full diameter slit through the radial center and cross-section of the concave disk to form cooperative sealing disk halves which deform to allow passage of the marking nib through slit upon linear advancement of the marker cartridge and marker nib by the marker carrier mechanism to an extended position.

These and other novel aspects of the present invention are herein described in particularized detail with specific reference to the accompanying Figures.

DETAILED DESCRIPTION OF PREFERRED AND ALTERNATE EMBODIMENTS

Figure 1:
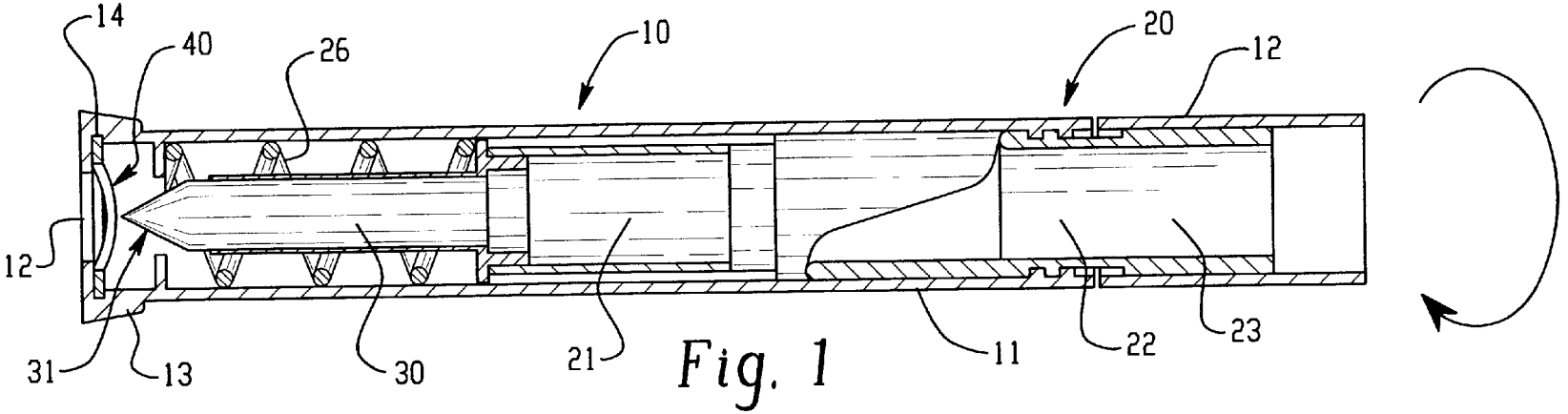
FIG. 1 is a cross-sectional view of a capless sealed marking instrument of the present invention in a fully retracted configuration.
Figure 2:
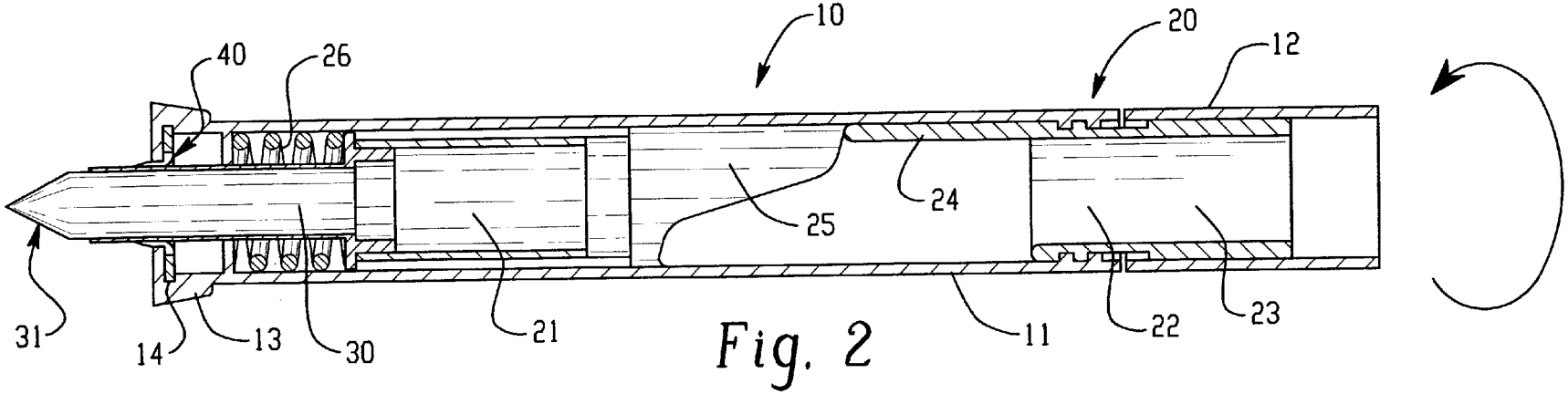
FIG. 2 is a cross-sectional view of the capless sealed marking instrument of FIG. 1 in an fully extended configuration.

With reference to FIGS. 1 and 2, there is illustrated a capless retractable sealed marking instrument, generally indicated at 10, which includes a marker casing 11 generally in the form of an elongate cylinder having an axial opening 12 formed in a marker tip cowling 13. The casing may be of any suitable diameter, and is preferably in the range of approximately ¾ of one inch to one inch in versions of the invention intended for use by children in order to improve manipulability of the instruments. The marker casing 11 houses a marker carrier mechanism, indicated generally at 20, which includes a marker cartridge receiver 21 attached to a linear extension and retraction assembly 22. In this embodiment, the linear extension and retraction mechanism 22 includes a rotatable driver 23 having a cam follower 24 in contact with a rotatable cam 25, biased against the driver by a spring 26, and selectively linearly translatable within the casing by rotation of a casing distal end 12, attached to the driver, to alter the point of contact of the driver cam follower 24 upon the cam 25.

An elongate marker cartridge 30 is fixedly held within the marker cartridge receiver 21 for linear translation relative to the casing in concert with the linear motion of the marker carrier mechanism 20. A marker nib 31 is integrally formed at a distal end of the marker cartridge. The marker cartridge may be formed of any fibrous, fabric or polymeric material capable of holding a substantial charge of ink which advances by capillary action to the marker nib for application to a writing surface. In the fully retracted position shown in FIG. 1, the marker nib 31 is entirely within the marker casing, surrounded by tip cowling 13 and proximate to opening 12.

Figure 3:
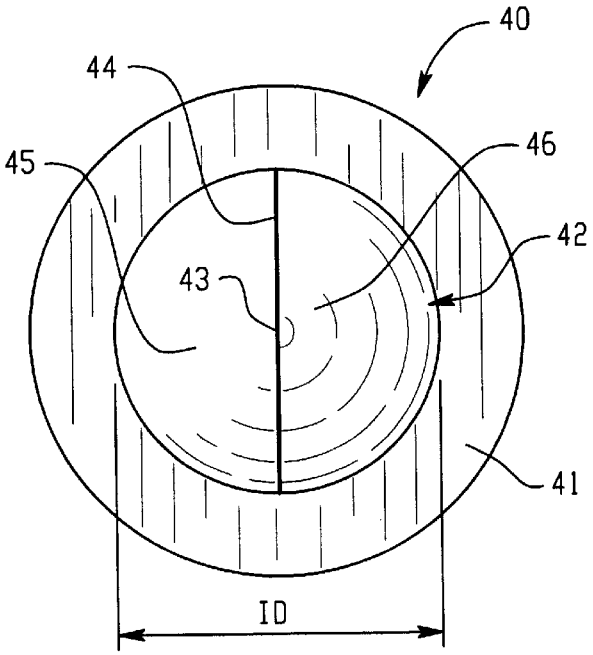
FIG. 3 is a plan view of the capless marker sealing disk of the present invention.
Figure 4:
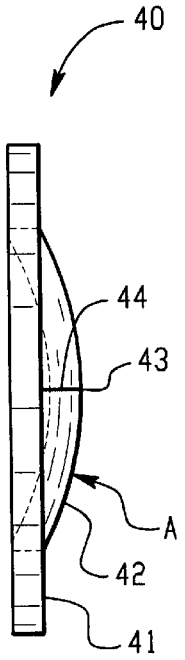
FIG. 4 is a side elevational view of the capless marker sealing disk of the present invention.
Figure 5:
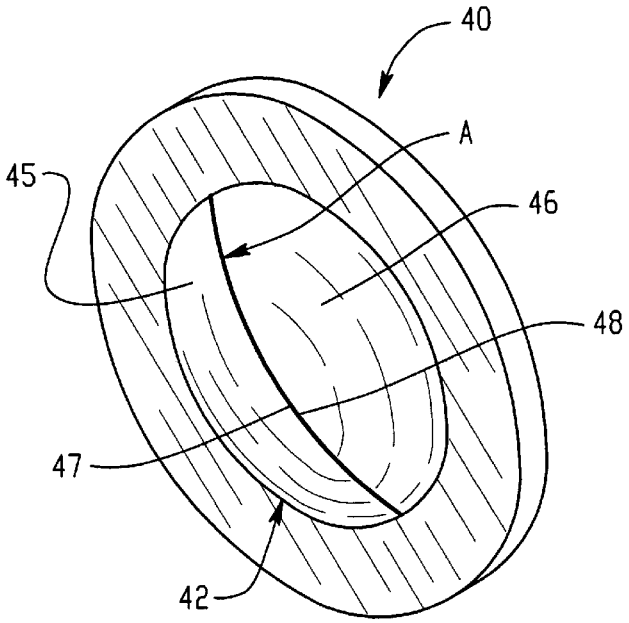
FIG. 5 is a perspective view of the capless marker sealing disk of the present invention.

A flexible elastomeric seal 40, shown in isolation in FIGS. 3–5, is held within the marker tip cowling 13. The seal 40 includes a generally annular rim 41 with an internal diameter (ID) at least equal to or greater than a diameter of opening 12. The annular rim 41 is fixedly held within the tip cowling 13 by insertion in an internal annular slot 14 in tip cowling 13. Adhesive may be used to fix the annular rim of the seal to the cowling. The seal 40 further includes a flexible concave disk 42 attached to and within the circular interior area defined by the annular rim 41. As best shown in FIG. 4, the concave disk 42 has a cross-section in the form of an arc A, with an apex 43 of the arc oriented to face the marker nib 31 when the marker nib is in a fully retracted position within the marker casing. The concave disk 42 further has a full-diameter, full-width slit 44 through the radial center of the disk which forms two cooperative sealing disk halves 45 and 46 which are deformable to allow passage of the marker nib through the slit upon linear advancement of the marker cartridge and marker nib by the marker carrier mechanism to an extended position.

The concavity of the disk halves 45 and 46 biases the mating edges 47 and 48 tightly together to form a highly effective atmospheric seal to the interior of the marker casing, thereby retaining the ink moisture in the marker nib and the marker cartridge. The concavity of the disk halves with the apex 43 oriented into the interior of the marker casing and toward the marker tip is especially effective in forming a seal sufficient to retain moisture within the marker cartridge and nib. As shown in FIG. 2, the marker nib is linearly projected through the seal 40 and opening 12, thereby deflecting the disk halves 45 and 46 to spread about the slit. In this position, the disk halves are tightly wrapped about the circumference of the marker cartridge, thereby effectively sealing the section of the marker cartridge which remains in the casing from the atmosphere, while the marker nib is exposed. Upon retraction, the disk halves effectively wipe the marker nib clean as they are brought back to the sealed concave position by the linear motion of the cartridge. The concave configuration of the disk halves is especially effective in establishing a tight seal since the amount of force required of the tip to urge the halves apart is greater than required for a convex, outwardly oriented seal. Also, upon retraction, the marker nib mechanically drags the disk halves back to the concave position, forcing the mating surfaces together to reestablish the seal. Also, because there is only a single slit which defines two relatively movable parts of the seal, the slight rotation in this embodiment of the marker nib and cartridge upon extension and retraction does not mechanically deform or interfere with the opening and closing of the seal.

The seal 40 is preferably formed or molded in the described configuration from a suitable silicon material such as GE® Silicon SE 6260, a high performance moldable and pigmentable silicon compound.

Figure 6:
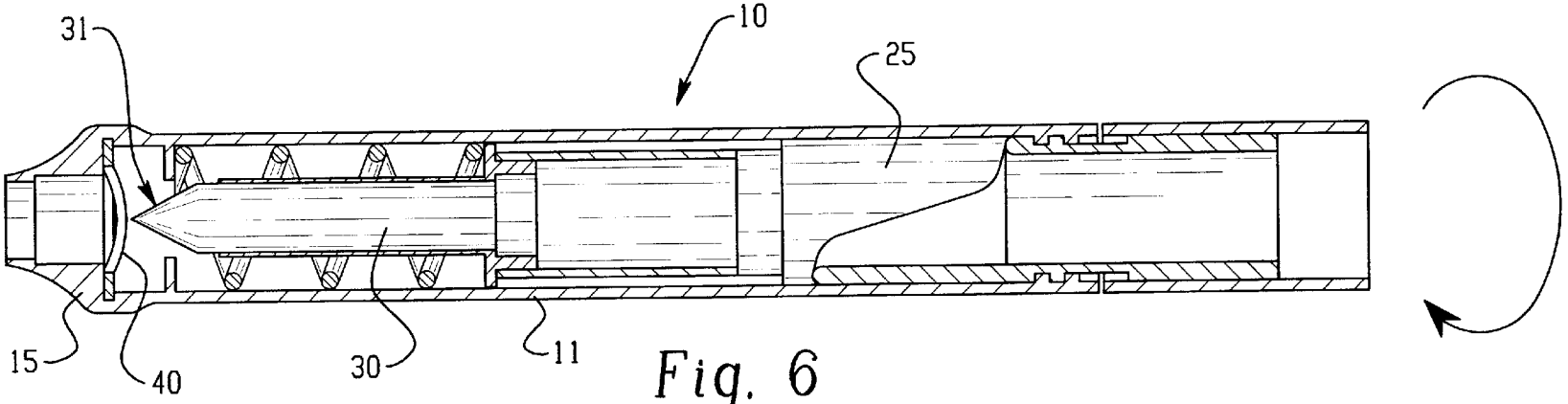
FIG. 6 is a cross-sectional view of an alternate embodiment of a capless sealed marking instrument of the present invention in a fully retracted configuration.
Figure 7:
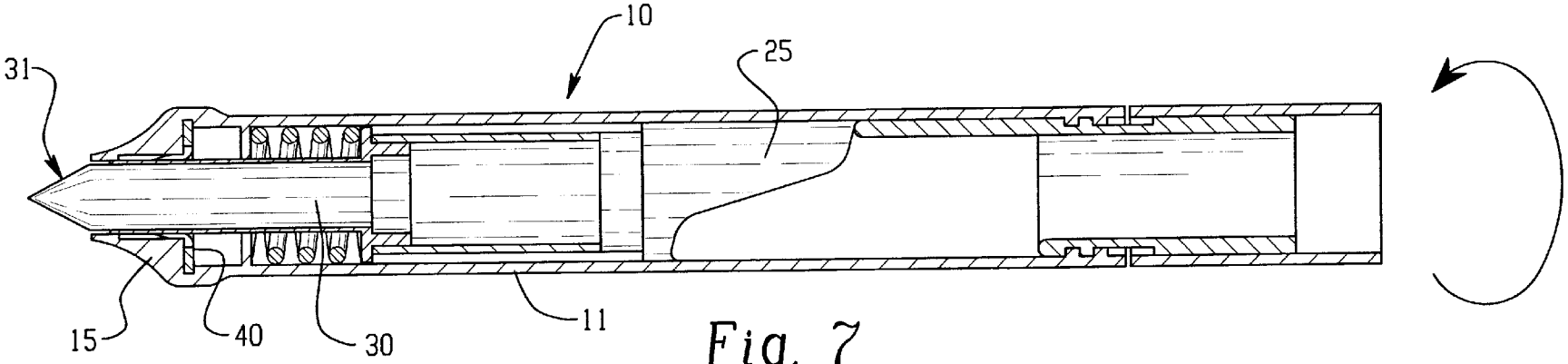
FIG. 7 is a cross-sectional view of the capless sealed marking instrument of FIG. 6 in a fully extended configuration.

In the embodiment of FIGS. 6 and 7, an extended cowling 15 is elongated and tapered to provide additional protection for the seal against external mechanical or atmospheric attack. The seal 40 is oriented the same as described with reference to FIGS. 1 and 2. The extended cowling 15 also provides additional lateral support to the section of the marker cartridge proximate the marker nib. The cam 25 can be designed to advance the marker nib only to the extent shown in FIG. 7 in order to prevent breakage of the marker cartridge.

Figure 8:
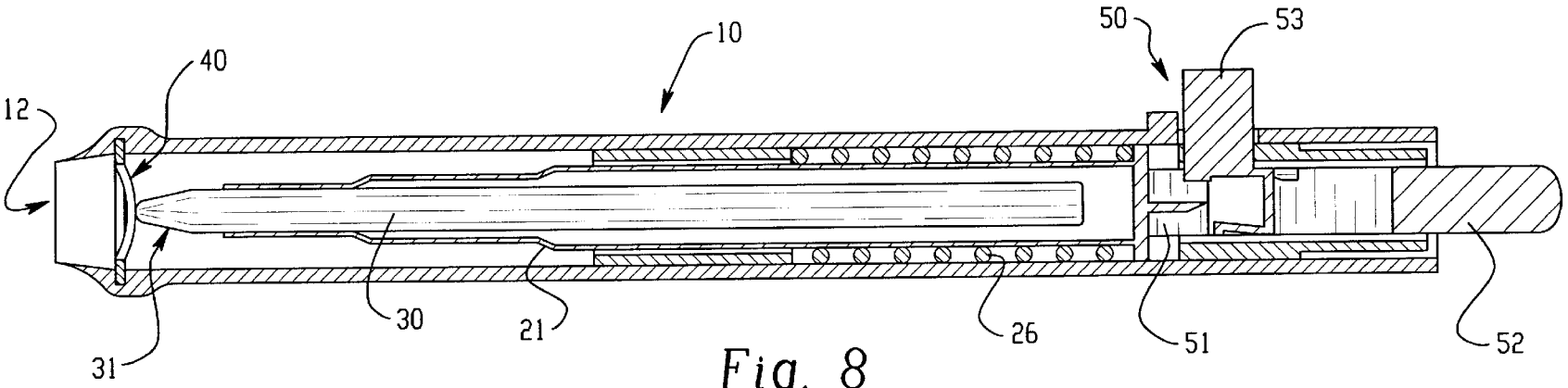
FIG. 8 is a cross-sectional view of an alternate embodiment of the capless sealed marking instrument of the present invention in a fully retracted configuration.
Figure 9:
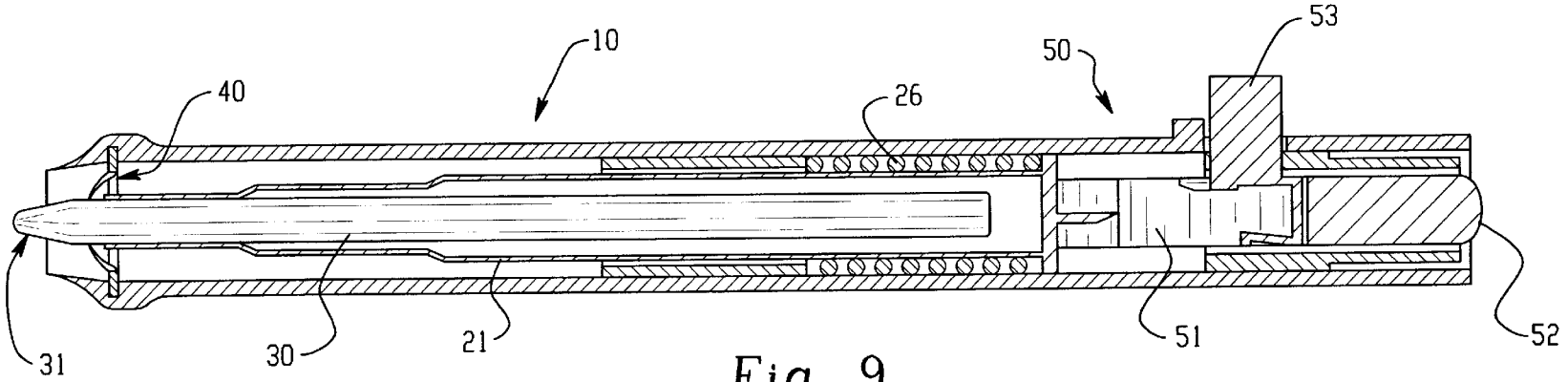
FIG. 9 is a cross-sectional view of the capless sealed marking instrument of the FIG. 8 in a fully extended configuration.

In the embodiment of FIGS. 8 and 9, a ratchet mechanism, indicated generally at 50, is employed as the marker carrier. The marker cartridge receiver 21 is connected to pushrod 51 which is linearly actuated by a plunger 52 which protrudes from an open end 16 in the marker casing, opposite opening 12. The pushrod 51 is held in an extended or retracted position by contact of a ratchet follower 53 which protrudes laterally from the marker casing. The ratchet follower engages and disengages from notches in the pushrod which correspond with the extended and retracted positions of the marker nib. The ratchet mechanism is biased to the retracted position of FIG. 8 by spring 26.

The invention thus provides capless retractable sealed marking instruments which can carry a substantial amount of marking ink in the marking cartridge which is effectively sealed from dehydration by a single piece concave seal in the marker casing. In any of the described embodiments, the marker nib is easily extended and retracted through the seal and the opening in the marker casing by actuation of the marker carrier mechanism, and the necessity of a cap or other separate closure piece is entirely eliminated.

Although the invention has been described with specific reference to certain preferred and alternate embodiments, other modifications and variations of the invention, including adaptation or incorporation of the inventive seal into markers and marker casings of different sizes and configurations, are all within the scope of the invention as defined by the claims and equivalents.

What is claimed is:

1. A capless retractable sealed writing instrument comprising:

an elongate marker casing with an axial opening, a marker cartridge having a marker nib and held within a marker carrier mechanism within the marker casing, the marker carrier mechanism operative to linearly move the marker cartridge and marker nib within the marker casing, to extend and retract the marker nib through the axial opening in the marker casing, and a single piece seal held within the marker casing proximate to the open end of the marker casing, the single piece seal having a generally annular rim held within the marker casing in a plane generally perpendicular to a longitudinal axis of the marker casing, and a concave flexible disk attached to and within a circular area defined by the annular rim, the concave disk having a cross-section in the form of an arc with an apex of the arc oriented to face the marking nib when the marking nib is in a fully retracted position within the marker casing, and a full diameter slit through the radial center and cross-section of the concave disk, from one point of the internal diameter of the annular rim to a radially opposite point, to form cooperative sealing disk halves which are deflectable away from the slit to allow passage of the marker nib through the seal upon linear movement of the marker cartridge and marker nib by the marker carrier mechanism to an extended position, and which return to a concave sealed configuration upon retraction of the marker nib into the marker casing.

2. The capless retractable sealed writing instrument of claim 1 wherein the sealing disk halves further comprise mating surfaces equal in length to the length of the full diameter slit and equal in thickness to the thickness of the disk halves, the mating surfaces of the sealing disk halves being substantially flush when the seal is in a closed configuration.

3. The capless retractable sealed writing instrument of claim 1 wherein the sealing disk halves of the seal are moved to a side of the annular rim opposite the side of the annular rim on which the apex of the cross-sectional arc is located when the seal is in a closed configuration.

4. The capless retractable sealed writing instrument of claim 1 wherein the marker carrier mechanism comprises a marker cartridge receiver, a rotatable cam, and a rotatable cam follower.

5. The capless retractable sealed writing instrument of claim 1 wherein the marker carrier mechanism comprising a marker receiver connected to a pushrod having indentations in contact with a ratchet, and a plunger in linear alignment with the pushrod.

6. The capless retractable sealed writing instrument of claim 1 further comprising a cowling attached to the marker casing about the axial opening in the casing, the cowling having an axial opening in alignment with the axial opening in the casing, and wherein the marker nib is advanced by the marker carrier mechanism through the seal, the axial opening in the casing, and the axial opening in the cowling to reach a fully extended position.

7. A flexible elastomeric single piece marking instrument seal specifically configured for incorporation in marker instruments having a marker cartridge and marker nib susceptible to atmospheric degradation, the marker seal comprising:

an annular rim having an outer diameter approximately equal to an inner diameter of a marker casing of a marking instrument into which the seal is to be incorporated, and an inner diameter at least equal to a diameter of a marker nib of a marking instrument into which the seal is to be incorporated, the annular rim having a thickness dimension equal to a thickness dimension of flexible elastomeric material from which the seal is formed, the annular rim being generally planar so that the plane of the annular rim can be oriented generally perpendicular to a longitudinal axis of a marker casing of a marking instrument into which the seal is to be incorporated, a concave sealing disk attached to and extending over a circular area defined within the internal diameter of the annular rim, a cross-section of the concave sealing disk being in the form of an arc, the arc having an apex orientable toward an interior of a marker instrument casing into which the seal is incorporated, the concave sealing disk further comprising a full diameter slit through a radial center and cross-section of the disk, cooperative sealing disk halves on either side of the full diameter slit, the cooperative sealing disk halves having lateral sealing surfaces which are substantially flush along an entire length of the slit when the disk is in a sealed configuration, the cooperative sealing disk halves being deflectable to a non-concave configuration by a marker nib which is linearly advanced from an interior of a marking instrument into the seal, contacting the seal approximately at the apex, and the cooperative sealing disk halves being returnable to a sealed concave configuration with the lateral sealing surfaces in substantially flush contact upon retraction of a marker nib through the slit and out of contact with the sealing disk halves.

* * * * *